US005242212A

United States Patent [19]

Polley

[11] Patent Number: 5,242,212

[45] Date of Patent: * Sep. 7, 1993

[54] POSTURE POD

[76] Inventor: Robert F. L. Polley, Suite 15-A, 1100 University St., Seattle, Wash. 98101

[ * ] Notice: The portion of the term of this patent subsequent to Dec. 11, 2007 has been disclaimed.

[21] Appl. No.: 568,982

[22] Filed: Aug. 17, 1990

Related U.S. Application Data

[63] Continuation-in-part of Ser. No. 385,725, Jul. 26, 1989, Pat. No. 4,976,494.

[51] Int. Cl.[5] ..... A47D 1/00

[52] U.S. Cl. ..... 297/464; 297/327; 297/466

[58] Field of Search ..... 297/326-328, 297/464, 465, 466, 467; 602/23, 29

[56] References Cited

U.S. PATENT DOCUMENTS

| | | | |
|---|---|---|---|
| 100,083 | 2/1870 | Stephan . | |
| 358,454 | 3/1887 | Johnson | 297/327 X |
| 659,216 | 10/1900 | Dowling et al. | 297/327 X |
| 1,624,986 | 4/1927 | Sherrod . | |
| 1,964,424 | 6/1934 | Borah . | |
| 2,968,337 | 1/1961 | Bartlett . | |
| 3,071,410 | 1/1963 | Gaskins | 297/195 |
| 3,163,409 | 12/1964 | Running et al. | 267/1 |
| 3,528,657 | 9/1970 | Krupsky | 272/85 |
| 3,563,601 | 2/1971 | Dickey | 297/466 |
| 3,733,104 | 5/1973 | Carstensen | 297/377 |
| 3,754,787 | 8/1973 | Garber | 297/390 |
| 4,072,318 | 2/1978 | Laune | 297/328 X |
| 4,145,082 | 3/1979 | Daly et al. | 297/466 |
| 4,160,553 | 7/1979 | Fleischer | 280/87.02 W |
| 4,416,465 | 11/1983 | Winiecki | 280/290 |
| 4,674,800 | 6/1987 | Ensign | 297/465 |
| 4,858,991 | 8/1989 | Boyesen | 297/195 |
| 4,976,494 | 12/1990 | Polley | 297/464 |

FOREIGN PATENT DOCUMENTS

| | | | |
|---|---|---|---|
| 1345571 | 11/1963 | France | 297/326 |

OTHER PUBLICATIONS

Hensinger, Robert N., M.D.; "Congential Dislocation of the Hip," vol. 31, No. 1 of Clinical Symposia; pp. 3-17.

Salter, Robert Bruce; "The Musculoskeletal System;" *An Introduction to Orthopaedics, Fractures and Joint Injuries, Rheumatology,* Metabolic Bone Disease and Rehabilitation; Second Edition; Williams & Wilkins; Baltimore/London; pp. 122-131.

Polley, Robert L. F., M.D.; "Call the Doctor;" *Parents Handbook,* 1971; Seattle, Wash.; pp. 27-32.

*Primary Examiner*—Peter R. Brown

*Attorney, Agent, or Firm*—Christensen, O'Connor, Johnson & Kindness

[57] ABSTRACT

A posture pod (112) is supported and elevated above the ground by a stand (113). The posture pod includes an anterior portion (114), a posterior portion (116), a bottom portion (118), and two leg openings (120) separated by a wide crotch portion (122). A thigh collar (128) encircles and projects outwardly from each leg opening. The legs of an infant received within the posture pod project through the leg openings. The posture pod is constructed to maintain the infant's hips such that the legs are abducted at an angle of approximately 20 degrees to 30 degrees and flexed to promote normal development of the infant's hips. The posture pod can be selectively positioned between a reclined position, in which the infant is supported by the posterior portion of the pod, and an inclined position, in which the infant is supported by the anterior portion of the pod.

13 Claims, 6 Drawing Sheets

POSTURE POD

This application is a continuation-in-part application under 35 U.S.C. §120 of prior U.S. patent application Ser. No. 385,725, filed on Jul. 26, 1989, and issued as U.S. Pat. No. 4,976,494 on Dec. 4, 1990, of Robert F. Polley for a FORWARD RECUMBENT POSTURE POD.

BACKGROUND OF THE INVENTION

The present invention relates to a forward recumbent posture pod for supporting the anterior torso of an infant resting therein while permitting unrestricted movement of the person's arms, legs and head to a posture pod configuration that abducts the flexed hip sufficiently to stabilize the head of the femur in the hip's acetabulum socket and thereby assist in the normal growth and development of the hip joint.

Full-term newborn infants generally have well developed posterior muscles of the neck and trunk. However, a newborn infant typically has weak anterior neck muscles, and if lying or held supine with its face up, is unable to lift its head. A newborn infant left in the supine position is relatively helpless, only able to move its arms and legs and unable to view the world around it. Newborn infants left in this position tend to grow irritable and restless.

In contrast, a full-term newborn infant that is seated or being held with his or her torso supported and forwardly inclined is able to lift and support its head, and turn its head from side-to-side to look about. Infants supported in this forward recumbent position are able to move their bodies in a swimming motion and intake the sensory stimulation surrounding it such as their mother's voice. Infants so positioned tend to find this posture highly pleasurable, and are far less likely to be irritable and restless.

Conventional infant seats, exercisers, and swings are not designed to recognize the limited development of a baby's anterior neck muscles or to take advantage of the baby's strong posterior neck and trunk muscles. Typical infant seats support a baby reclined backwards in a semi-supine position, while infant swings and exercisers tend to support an infant in an upright or semi-reclined position. One conventional configuration of an infant exercise seat is disclosed by U.S. Pat. No. 3,528,657, issued to Krupsky, which discloses an infant swing wherein the infant is seated with its back vertically upright, or alternately, in a fully supine reclined position.

An alternate conventional configuration that provides anterior support for a person resting in a semi-inclined recumbent position is disclosed in U.S. Pat. No. 3,733,104, issued to Carstensen. The body support disclosed in that patent provides an inclined board upon which a person rests his or her full frontal body. However, depending on the board's configuration, the support does not allow free movement of the legs, or at most provides for movement of the legs only as a means of propelling the support board when mounted as a mobile walker. In addition, the arms and head rest upon slanted board surfaces that restrict their free downward movement. Further, such a board would be unsafe for young infants as the infants are not restrained from sliding off of the board sideways or from falling off the board backwards as a result of back arching.

Adduction of the hips refers to the infant's legs being drawn together in parallel fashion. Flexion refers to drawing the infant's thighs toward the abdomen and abduction refers to the legs being spread apart from each other. During the first few months of life, due to imperfect formation of the acetabulum and lax ligaments, it is not unusual for an infant's hip joint to develop subluxation. This is a situation where the head of the femur does not have a stable concentric and congruent perfect fit and is somewhat loose in the socket. Such subluxation of the hip joint can lead to a serious condition, congenital dislocation of the hip (CDH).

Adduction and extension are known to increase the subluxation-dislocation tendency, while a position of flexion and abduction encourages a stable perfect fit with subsequent normal development and growth of both the head of the femur and the socket or acetabulum, resulting in a stable, normal hip joint. Because the hip joint doubles in size during this period, the most rapid growth period, a normal relationship of the femur head and hip socket is most important during the first five to six months of life.

SUMMARY OF THE INVENTION

The present invention has been developed to solve the aforementioned limitations and problems of conventional infant seats and exercisers. The present invention discloses a forward recumbent infant posture pod that supports the anterior of an infant's torso while allowing the infant substantially unrestricted movement of its arms, legs, and head. A first preferred embodiment of a posture pod comprises a base to which one end of an arc-shaped spring is pivotally secured, and an upwardly concave support member, slidably secured to the second end of the spring and spaced away from the base by the spring, for cradling the infant.

In this first preferred embodiment, the support member is a unitary pod forming a cavity, with two openings included in the base of the cavity so that an infant may be inserted into the pod with its legs protruding through the openings. The pod has an anterior portion against which the infant's torso rests and a bottom portion passing between the infant's legs to support the infant's buttocks. The pod also includes side and posterior portions surrounding the sides and back of the infant respectively, to prevent the infant from sliding to either side out of the pod or falling backwards out of the pod.

The first end of the arc-shaped spring is tangential to, and pivotally secured to, the base. The second end of the spring is tangential to the posterior portion of the pod, with the pod slidably secured to the inside radius of the spring. This configuration causes the pod to be spaced away from the base, with the anterior portion of the pod inclined forwardly from a true vertical position. When an infant is resting in the pod, its weight is supported by the anterior portion of the pod, which covers the infant's shoulders, chest, and stomach, as well as by the bottom portion of the pod, which supports the infant's buttocks. The infant's head and arms protrude above the pod and are substantially unrestrained. Due to the upward spacing of the pod by the arc-shaped spring, the infant's arms and legs are elevated above the base for free mobility. The flexibility of the arc-shaped spring allows the infant some freedom to gently undulate the pod up and down slightly by moving its arms, legs, neck and head, entertaining the infant with the pod's responsive movement.

Two positioning means are included to allow adjustment of the posture pod to increase to decrease the incline of the pod. Two adjustment bars are secured to the base on either side of and parallel to the first end of the curved spring. A plurality of grooves, oriented perpendicular to the first end of the spring, are formed across the top of the adjustment bars. An adjustment rod is located between the first end of the spring base, and rests in one set of the grooves. This causes the spring to rotate upwardly away from the base, increasing the forward incline of the attached pod with respect to the base. The incline of the pod is selectively adjusted by moving the adjustment bar to the desired set of grooves formed across the adjustment bars.

The position of the pod may be further adjusted to change its angle of incline by selecting the point of attachment of the pod to the second end of the spring. A channel is formed within the anterior of the pod, terminating in an opening in proximity to the bottom portion of the pod, into which the second end of the arc-shaped spring is slidably inserted. An adjustment knob is threadably inserted through the posterior portion of the pod and may be tightened down against the second end of the spring. The angle of incline of the pod is adjusted by inserting the second end of the spring to different depths within the channel and then tightening the adjustment knob, locating the pod at the desired positions along the arc of the spring.

By moving the adjustment rod to select the amount of rotation of the spring away from the base, and slidably adjusting the depth of insertion of the spring into the channel formed in the anterior portion of the pod, the angle of incline of the pod with respect to the base can be selectively adjusted to place the pod in a fully upright position, a fully inclined position, or intermediate positions therebetween. In the fully upright position, the anterior portion of the support member is inclined just slightly from an orthogonal to the base. In the fully inclined position, the anterior portion of the support member is inclined so as to be approaching a parallel to the base.

The posture pod includes a plurality of elongated stabilizing outriggers that are pivotally secured to the underside of the base and rotatably positionable to increase the area of the base as required for added stability. When the posture pod is adjusted so as to be in or near its fully upright position, the stabilizers may be rotated to project beyond the rear edge and sides of the base. When the posture pod is adjusted to be in or near its fully inclined position, the stabilizers may be rotated to project beyond the front edge and sides of the base.

In a variant of this first preferred embodiment, a plurality of elongated stabilizing outriggers are slidably secured to the underside of the base, and are positionable to increase the area of the base to the front, the sides and the rear simultaneously for maximum stability.

The posture pod is primarily for use by infants from age one or two weeks through about age six months, by which time the infant's arms, torso, and neck have usually developed sufficient strength to lift the infant's head and upper body upwardly from the prone position. Use of the posture pod during this period facilities development of the infant's muscles while allowing the infant safe and pleasurable use of its limited abilities. As the infant matures and develops, its posterior neck and back strength increases and the posture pod is preferably forwardly inclined further and further towards its fully inclined position.

In a second preferred embodiment, the posture pod is configured to maintain the infant's flexed hips in an abduction position to promote normal development of the hip joint. This abduction pod performs its abduction function whether forwardly inclined, in an upright, or semi-inclined position. To ensure the desired degree of abduction and flexion of the hip, the abduction pod includes a crotch portion between the leg openings, having a width sufficient to maintain the legs separated at the desired degree of abduction. Preferably the abduction posture pod also includes a collar surrounding each leg opening and projecting outwardly a distance sufficient to comfortably support the thigh in the flexed, abducted position regardless of the recline or incline of the posture pod. A comfortable and natural hip flexion angle is approximately 30 degrees from alignment with the infant's back. A comfortable degree of effective abduction of the hips refers to the legs being spread apart from each other at an angle of approximately 25 degrees from the infant's central line of symmetry.

The posture pod may be supported and elevated above a base by an arcshaped spring, as described above. Alternately, other elevation members which permit the posture pod to adjustably recline and incline may be utilized. In the preferred second embodiment, the elevation member and based are formed from an integral length of structural tubing configured to form the base and elevation member.

Padded liners, conforming to the interior contour of the pod, may be detachably inserted into all of the above embodiments for a posture pod for padding and absorbency. The use of liners of varied thickness allow the pod to be adjusted to accommodate infants of differing sizes.

BRIEF DESCRIPTION OF THE DRAWINGS

The invention will presently be described in greater detail, by way of example, with reference to the accompanying drawings in which.

DETAILED DESCRIPTION OF A FIRST PREFERRED EMBODIMENT

Figure 1:
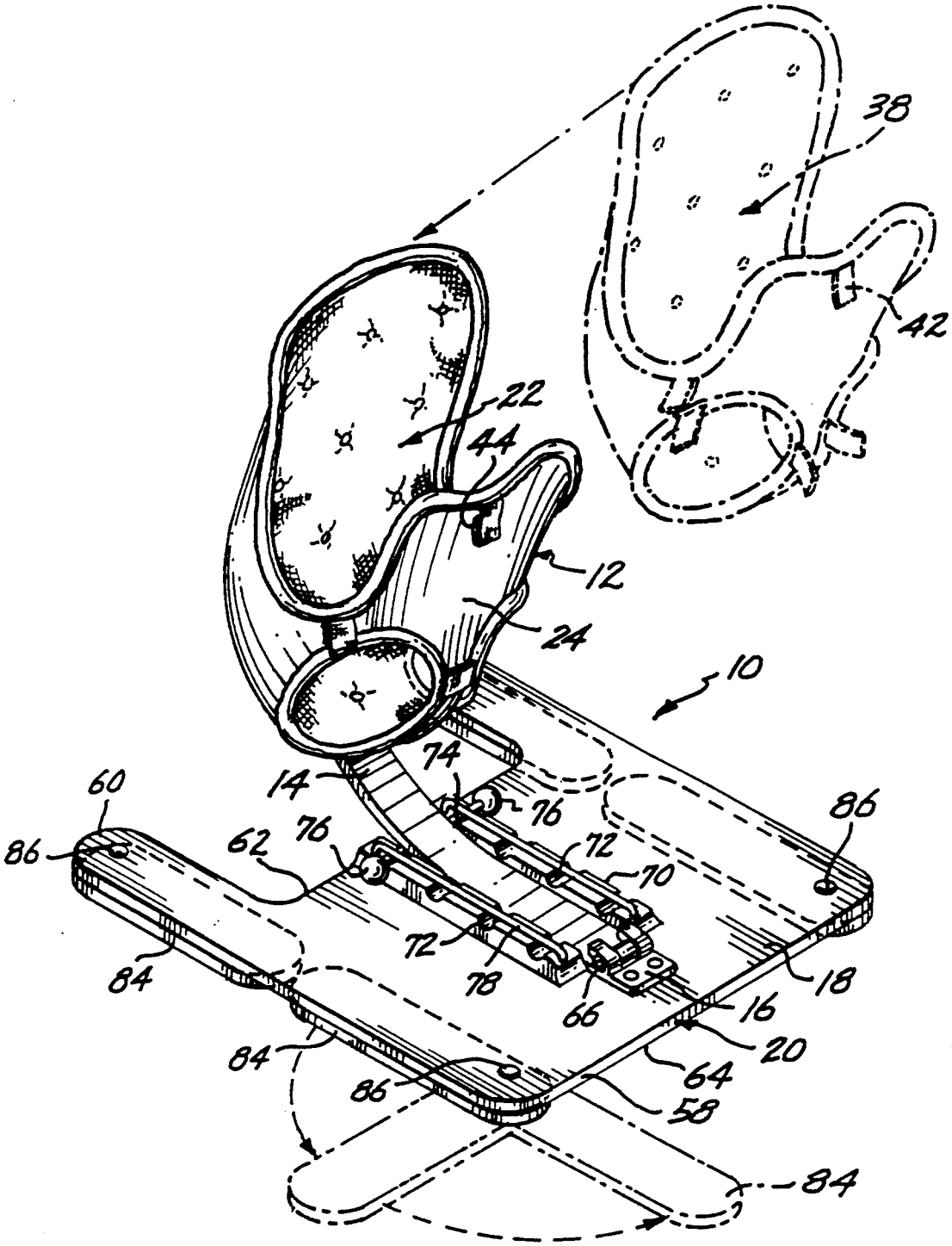
FIG. 1 is an isometric view of a first preferred embodiment of the posture pod in its fully upright position, with dashed lines showing movement of the stabilizing outriggers and contour of the padded liner.

FIG. 1 illustrates a first preferred embodiment of a forward recumbent posture pod 10. A unitary pod 12 is secured to and elevated by an arc-shaped spring 14 that is in turn pivotally secured by a hinge 16 to the upper surface 18 of a substantially flat base 20.

The pod 12 is preferably constructed of a high-strength thermoplastic, but could alternately be made of any high-strength lightweight material, such as glass fiber reinforced polyester resin, aluminum, or steel wire mesh. The base 20 is likewise preferably constructed of a high-strength thermoplastic, but may alternately be constructed of other strong, lightweight materials, such as wood, glass fiber reinforced thermosetting plastic, or sheet steel. The arc-shaped spring 14 is formed an elongated strip of a suitable material such as fiber reinforced polyester resin or spring steel.

Figure 3:
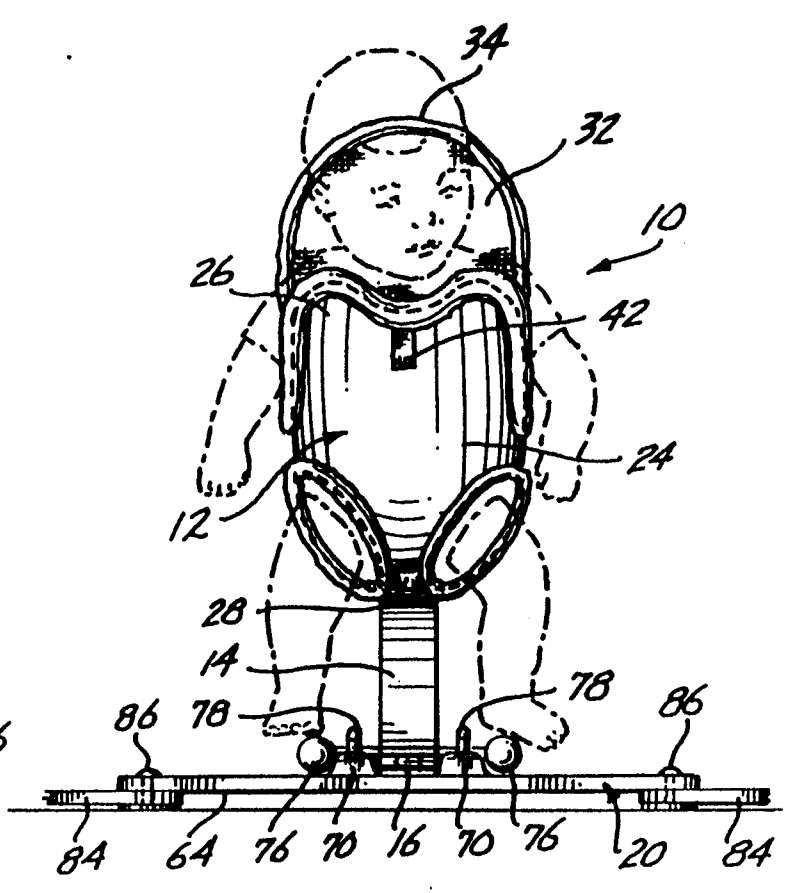
FIG. 3 is a front elevation view of the posture pod of FIG. 1 in its fully upright position.
Figure 2:
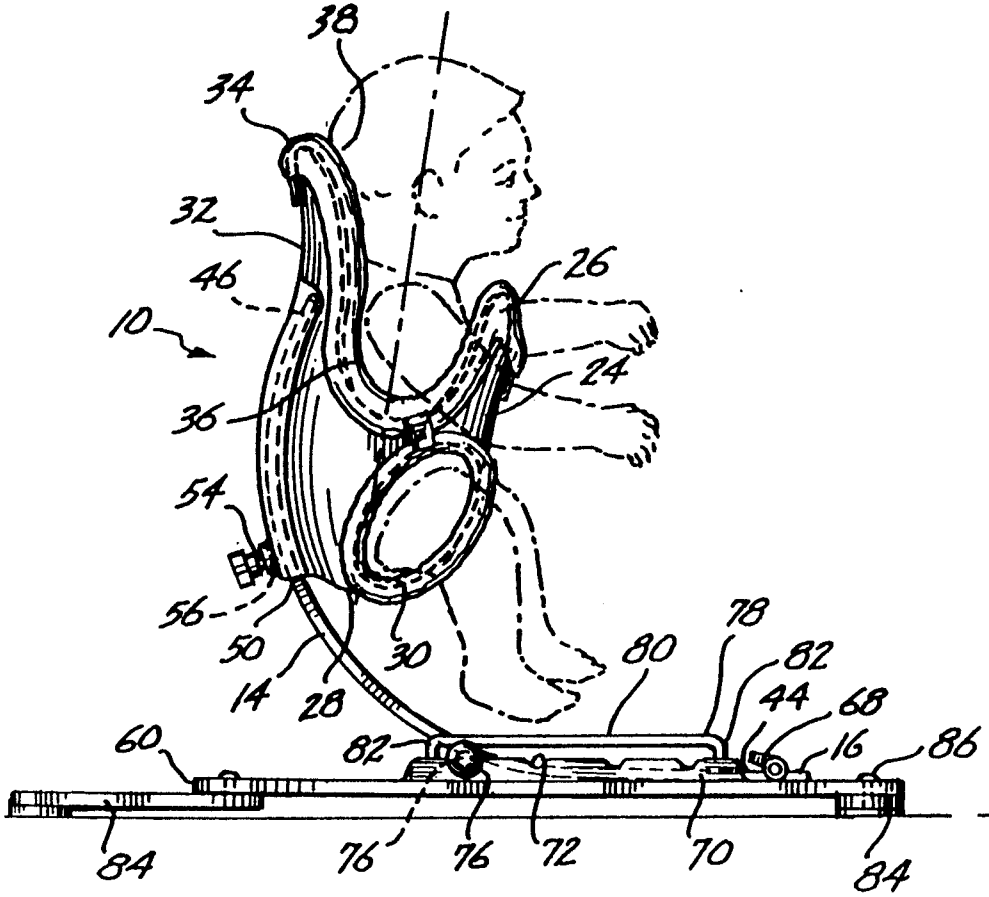
FIG. 2 is a side elevation view of the posture pod of FIG. 1 in its fully upright position.

The pod 12 forms a cavity 22 into which an infant is inserted. Referring to FIGS. 2 and 3, which illustrate side elevation and front elevation views, respectively, of an infant resting within posture pod 10, the unitary pod 12 includes an anterior portion 24 for supporting the front of the infant's torso. The anterior portion 24 is contoured to cover the infant's abdomen and chest, and terminates along its uppermost edge in two roughly semicircular shoulder extensions 26 to cover and support the infant's shoulders. The unitary pod 12 has an upwardly concave bottom portion 28 that includes two circular leg openings 30. When an infant is seated in the posture pod, its legs project through openings 30 and its buttocks rest in the bottom portion 28.

The pod 12 also includes a posterior portion 32, rising upwardly from the bottom portion 28, and parallel to anterior portion 24, to cover the back, neck and base of the head of the infant. The uppermost edge 34 of the posterior portion 32 is flared outwardly from the pod 12 to avoid an abrupt edge should the infant's head strike that portion of the pod 12. The anterior portion 24 and posterior portion 32 are joined on either side by two narrow side portions 34 of the pod 12. Two open-ended, semicircular arm channels 36 are formed between the anterior portion 24 and posterior portion 32 above the side portions 34. When an infant is inserted into the pod 12, its arms project through the arm channels 36 for substantially unrestricted movement.

Referring again to FIG. 1, the posture pod 10 includes a padded liner 38 that is formed to replicate the inner contour of the cavity 22 of the pod 12, and includes two leg openings 40 corresponding to the leg openings 30 of the pod 12. In addition to providing padding and absorbency for the pod 12, the thickness of the padding material used to make the padded liner 38, such as fiberglass batting sandwiched between cloth layers, can be sized to adjust the depth of the cavity 22 to accommodate infants of a particular size. Multiple padded liners 38 of differing thickness can be utilized to accommodate an infant as it grows. The padded liner 38 is preferably secured to the pod 12 by a plurality of loop-napped tabs 42 that are intermeshed with corresponding hook-napped fasteners 44 located on pod 12. Suitable looped and hooked napped tabs 42 and 44 are available under the trademark VELCRO TM. The padded liner 38 may alternately be attached by other means, such as snaps or elastic bands.

Referring to FIG. 2, it can be seen that the pod 12 is attached to, and spaced away from, the base 20 by the arc-shaped spring 14. The arc-shaped spring 14 has a first end 44 pivotally attached to the base 20 by hinge 16 and a second end attached to the posterior portion 32 of pod 12. The posterior portion 32 of the pod 12 has an elongated channel 48 formed within that is centered along the midline of posterior portion 32. Elongated channel 48 has a cross-sectional area matching that of the arc-shaped spring 14, and follows a curved path corresponding to the curvature of the arc-shaped spring 14. The elongated channel 48 terminates at opening 50 in proximity to the bottom portion 28 of the pod 12. An adjustment knob 52 with threaded shank 54 is threadably inserted through a hole 56 passing from the outside of the pod into the channel 48 in proximity to opening 50. The second end 46 of the spring 14 is inserted through the hole 50 into the channel 48 and is secured by tightening adjustment knob 52. The depth of insertion of the second end 46 of the spring 14 into the channel 48 locates the pod 12 along the arc formed by the spring 14, and can be adjusted to change the position and incline of the pod 12, as shall be explained subsequently in greater detail.

The base 20 illustrated in the first preferred embodiment of FIG. 1 has a substantially square perimeter, including a front edge 58 and a rear edge 60, with a weight reducing rectangular cutout 62 formed in the center of edge 60. It should be apparent that other types of bases could be utilized, including a tubular ring and cross brace or an X-shaped tree, such as those used in chairs or other implements of furniture. In addition, although not illustrated in the preferred embodiment, casters could be secured to the bottom surface 64 of the base 20 for greater mobility.

Figure 4:
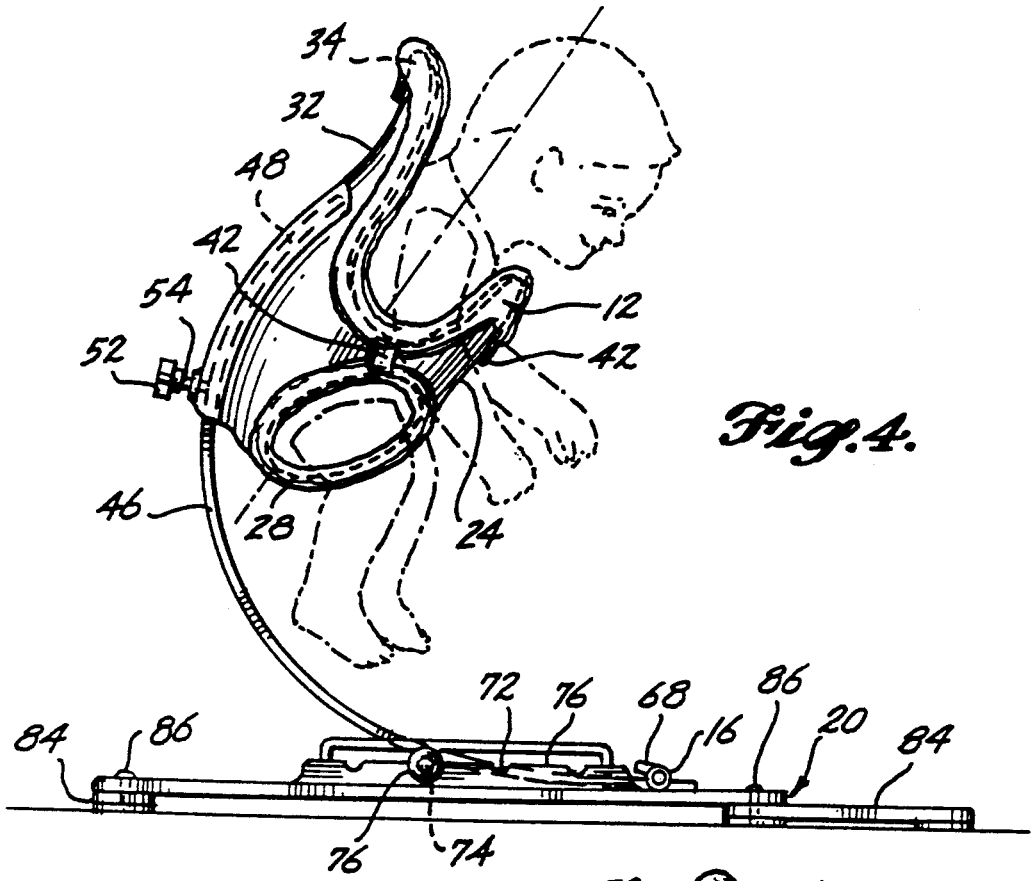
FIG. 4 is a side elevation view of the posture pod of FIG. 1 in an intermediate inclined position.
Figure 5:
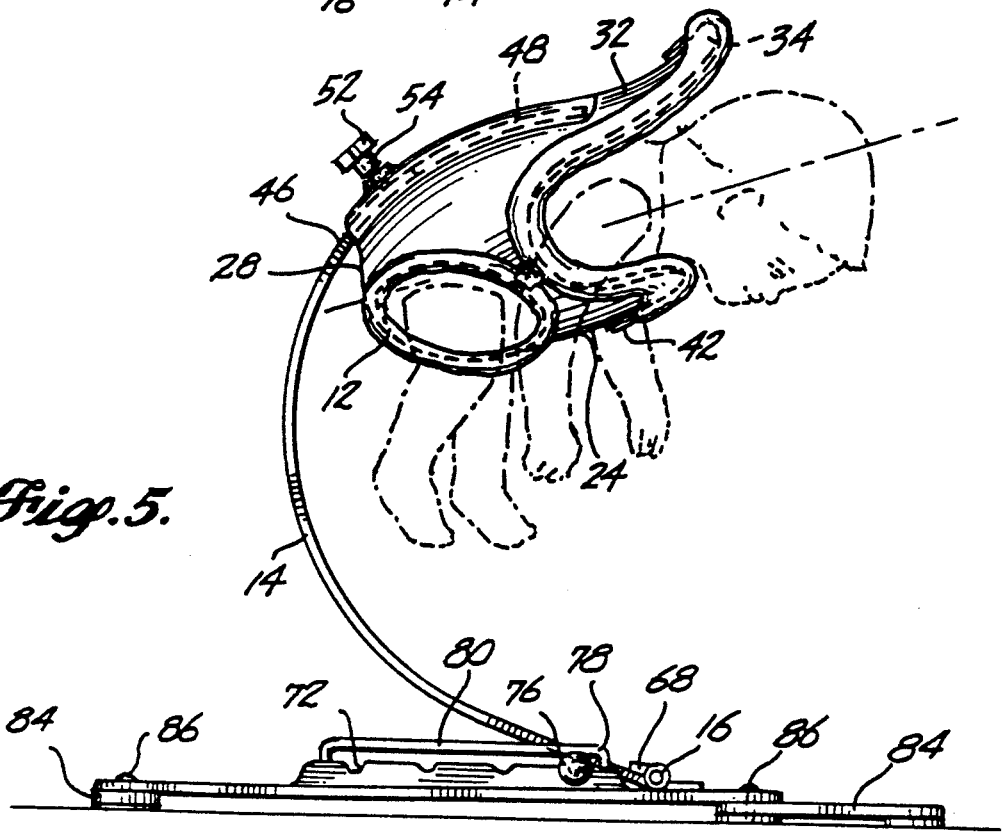
FIG. 5 is a side elevation view of the posture pod in its fully inclined position.

The second end 46 of the spring 14 is pivotally secured to the base 20 by a hinge 16 attached to the upper surface 18 of the base 20 at a midpoint along and in proximity to the front edge 58 of the base 20. A cylindrical rod 66 attached to the extreme edge of the first end 44 of spring 14 serves as the rotating half of the hinge 16. The spring 14 is pivotally secured to the base 20 so that it is normally tangential to the base 20, as illustrated in FIG. 2. The spring 14 can be rotated upwardly at hinge 16 away from its tangent with the base 20, as illustrated in FIGS. 4 and 5. A pair of lugs 68 are attached to the hinge 16 to limit the rotation of the spring 14 as illustrated in FIG. 5. The lugs 68 are secured to the upper extremity of hinge 16 and project toward and overlie slightly the first end of spring 14. When the spring 14 is rotated so that a tangent to the first end 44 creates an approximately 15 degree angle with the plane of the base 20, the spring 14 hits the lugs 68, preventing greater rotation and stabilizing the posture pod 10.

Referring again to FIG. 1, the posture pod 10 includes a positioning mechanism to selectively adjust the rotation of the spring 14 with respect to the base 20. Two identical parallelepiped positioning bars 70 are secured to the base 20, with one positioning bar 70 located on either side of, and parallel to, the first end of spring 14. A plurality of adjustment grooves 72 having semicircular cross sections are formed across the upper surface of each positioning bar 70. The adjustment grooves 72 have their longitudinal axes oriented perpendicularly to the tangent of the first end 44 of spring 14, and are equally spaced at increments along the length of each positioning bar 70, with the adjustment grooves 72 of one positioning bar 70 being aligned with the adjustment grooves of the other positioning bar 70. In the preferred embodiment of FIG. 1, four such sets of adjustment grooves 72 are illustrated, although other quantities of grooves may be employed.

A cylindrical adjustment rod 74 of sufficient length to span both positioning bars 70 is insertable into any set of adjustment grooves 72. As illustrated in FIG. 1, the adjustment rod 74 is inserted between the first end 44 of the spring 14 and the base 20, and is capable of being moved to rest in any set of grooves 72. Selectively placing the adjustment rod 74 into a set of adjustment grooves 72 that is closer or farther from the hinge 16 results in an increase or decrease, respectively, in the rotation of the spring 14 away from the base 20, and thus causes an increase or decrease, respectively, in the angle of incline of the pod 12 with respect to the base 20.

A spherical knob 76 is attached to each end of the adjustment rod 74 to prevent the rod from sliding out of the adjustment grooves 72. A keeper rod 78 is attached to each positioning bar 70 to prevent the adjustment rod 74 from coming free of the base 20. Referring to FIG. 2, the keeper rod 78 includes an elongated portion 80, with a short attachment portion 82 projecting perpendicularly from each end of the elongated portion 80. The keeper rods 78 are positioned parallel to and located above the positioning bars 70, with the short attachment portions 82 of each keeper rod 78 being secured to the extreme ends of the positioning bars 70. A space is thus created between the keeper rods 78 and the positioning bars 70, between which the adjustment rod 74 is disposed. The keeper rods 78 are spaced sufficiently away from the positioning bars 70 to allow free movement of the adjustment rods 74 between the various sets of adjustment grooves 72, but not so far away as to allow the spherical knobs 76 from passing through.

FIG. 2 illustrates the posture pod 10 located in a fully upright position. The second end 46 of the spring 14 is fully inserted into the elongated channel 48 formed within the posterior portion 32 of the pod 12. The adjustment knob 52 is tightened to advance threaded shank 54 to bear against spring 14 to secure the pod 12 in this position. To complete the positioning of the posture pod 10 in the fully upright position, the adjustment rod 74 is placed under the spring 14 in the set of adjustment grooves 72 located furthest from the hinge 16.

When in this fully upright position, the anterior portion 24 and posterior portion 32 of the pod 12 are inclined only slightly from orthogonal to the base, with the plane of the anterior portion 24 of the pod 12 creating an approximately 85 degree angle with the plane of the base 20. In this configuration, the first end 44 of the spring 14 is oriented so as to be tangential to the base 20. As illustrated in FIGS. 2 and 3, the weight of an infant residing in the posture pod 10 while located in this fully upright configuration is borne primarily by the bottom portion 28 of the pod 12. The infant is inclined very slightly forward to rest on the anterior portion 24 of the pod 12, but if the infant possesses sufficient posterior back muscles it may straighten its back to bear against the posterior portion 32 of the pod 12.

At the other extreme, FIG. 5 illustrates the posture pod 10 located in the fully inclined position. In this position, the second end 46 of the spring 14 is inserted only slightly into the channel 48 formed within the posterior portion 32 of the pod 12, where it is secured by tightening the adjustment knob 52 causing the threaded shank 54 to bear against the spring 14. When the second end 46 of the spring 14 is inserted only partially into the elongated channel 48, as shown in the inclined position, the unitary pod 12 is caused to project outwardly away from the extreme edge of the second end 46 of spring 14, following the arc cut by the spring 14 and resulting in a greater angle of incline of the pod 12 with respect to the base 20.

To complete the positioning of the posture pod 10 in this fully inclined position, the adjustment rod 74 is moved under the first end 44 of spring 14 to rest in the set of adjustment grooves 72 located in closest proximity to the hinge 16 on the base 20. This causes the spring 14 to rotate on hinge 16 away from the base 20, tilting the second end 46 of spring 14 and the unitary pod 12 towards the base 20.

When the posture pod 10 is placed in this fully inclined position, the anterior portion 24 and posterior portion 32 of the pod 12 are situated so as to approach a parallel to the base 20, with the plane of the anterior portion 24 of the pod 12 forming an approximately 5 degree angle with the plane of the base 20. As illustrated in FIG. 5, the weight of an infant residing in the posture pod 10 while so configured is borne primarily by the anterior portion 24 of the pod 12, and minimally by the bottom portion 28 of the pod 12. The infant's shoulders rest on the shoulder extensions 26 of the anterior portion 24 of the pod 12, with the infant's head and neck free to tilt slightly below the plane of the anterior portion 24 or to be lifted by the infant's muscles above the plane of the anterior portion 24.

The infant posture pod can be set at various intermediate positions, one example of which is illustrated in FIG. 4, located over the range spanning between the fully upright position of FIG. 2 and the fully inclined position of FIG. 5. This adjustment is completed by moving the adjustment rod 74 to the desired set of adjustment grooves 72 intermediate between the grooves 72 that are closest and furthest to the hinge 16, and adjusting the depth of insertion of the second end 46 of the spring 14 into the channel 48.

For added safety when utilized with heavier infants, the posture pod 10 preferably also includes a plurality of elongated outrigger members 84 for stabilizing the posture pod 10, as illustrated in FIG. 1. The elongated outriggers 84 are pivotally secured by pins 86 to the bottom surface 64 of the base 20 at each of its corners. These outriggers 84 may be pivoted to be positioned underneath the base 20 when not required, or pivoted to project outwardly from the base 20 along the plane of the base 20 when needed for additional stabilization, as indicated by dashed lines in FIG. 1.

One example of the utilization of the outriggers 84 is shown in FIG. 2, in which the posture pod 10 is located in its fully upright position. In this fully upright position, the weight of the infant tends to be centered above the rear of the base 20, so the outriggers 84 secured in proximity to the rear edge 60 of the base 20 are preferably pivoted to project outwardly from base 20 and perpendicular to the rear edge 60 to prevent the possibility of backwards tipping of the posture pod 10. In this configuration the outriggers 84 located in proximity to the front edge 58 of the base 20 may be pivoted to project outwardly from base 20 and parallel to the front edge 58 (FIGS. 2 and 3) for greater side stability of the posture pod 10 to prevent tipping to either side.

An additional utilization of the outriggers 84 is shown in FIG. 5, illustrating the posture pod 10 in its fully inclined position. In this position, the outriggers 84 located in proximity to the front edge 58 of the base 20 are pivoted to project outwardly and perpendicular to the front edge 58 to prevent forward tipping of the posture pod 10. The outriggers 84 located in proximity to the rear edge 60 of the base 20 are rotated to pivot outwardly and parallel to rear edge 60 of the base 20 to increase side stability of the posture pod 10 in this configuration. Note also that in this fully inclined position, the first end 44 of the spring 14 abuts the lugs 68 secured to the hinge 16 on the base 20 to prevent the spring 14 from further rotating away from the base 20 as an additional safety measure.

Figure 6:
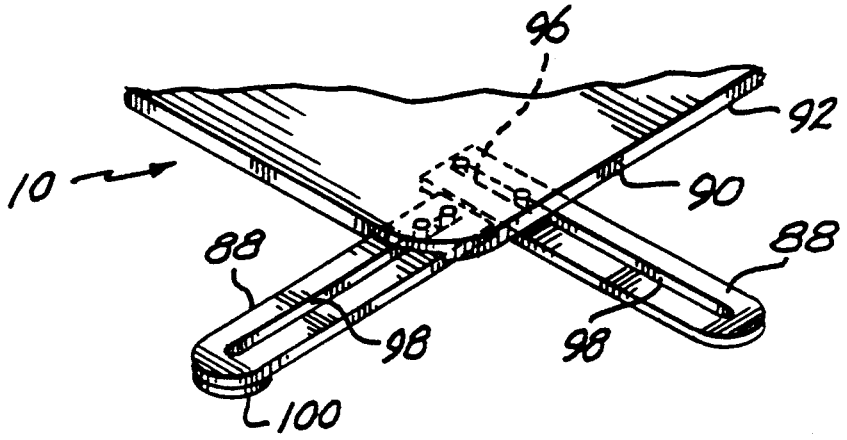
FIG. 6 is an isometric breakaway view of an alternate embodiment of the posture pod of FIG. 1 with the addition of slidably secured stabilizing outriggers.

An alternate embodiment of the posture pod 10 utilizes a plurality of elongated outrigger members 88 that are slidably secured to the bottom surface 90 of a base 92, as illustrated in FIG. 6. Two outriggers 88 are slidably secured to each corner of the base 92. The outriggers 88 are disposed so that when extended there are two outriggers 88 projecting orthogonally beyond each edge of the perimeter of the base 92, resulting in an increase in the area of the base 92 around its entire perimeter for maximum stability.

Figure 7:
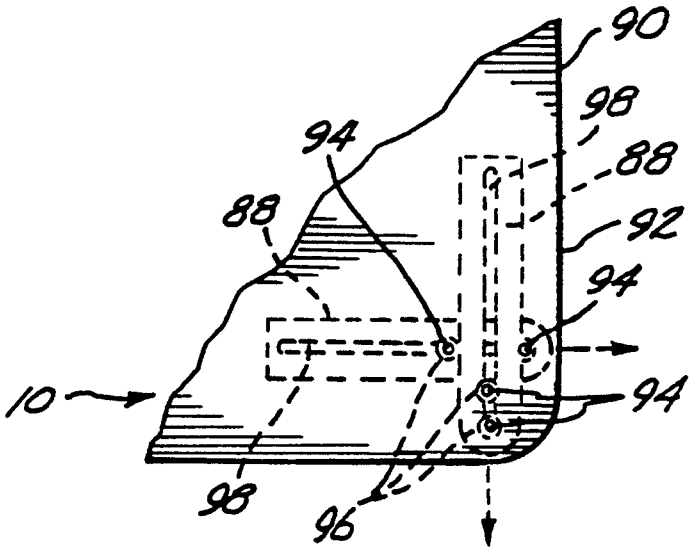
FIG. 7 is a top elevation breakaway view of the alternate embodiment of FIG. 6 illustrating the positioning of the stabilizing outriggers.

As further illustrated in FIG. 7, each outrigger 88 is secured to the base 92 by two pins 94 projecting downwardly from the bottom surface 90. Each pin 94 has a flanged head 96 that is inserted into slots 98 formed along the center line of each outrigger 88. At each corner of the base 92, a first outrigger 88 is mounted flush to the bottom surface 90 of the base 92, with a spacer 100, of the same thickness as an outrigger 88, attached to the outrigger's bottom surface. A second outrigger 88 is mounted perpendicularly to the first outrigger 88, and is spaced slightly away from the bottom surface 90 of the base 92, so that it passes under the first outrigger 88 as the outriggers 88 are slid in and out from under the base. All outriggers 88 may be slid underneath the base for compact storage.

OPERATION OF THE FIRST PREFERRED EMBODIMENT

The forward recumbent posture pod 10 of the present invention may be positioned in varying degrees of incline with respect to the base 20 as desired to accommodate the changing age and muscular development of the infant residing in posture pod 10. FIG. 2 illustrates the posture pod 10 in its fully upright position, as would be used for a newborn infant with very weak posterior neck and back strength, as well as for older infants that need to be in the upright position for feeding or other activities.

The infant is placed into the cavity 22 of the pod 12, with the infant's legs projecting through the leg openings 30 in the bottom portion 28 of the pod 12. The infant's arms are located between the upper extremities of the anterior portion 24 and posterior portion 32 of the pod 12. The infant is free to move its arms and legs in a substantially unrestricted manner. In this configuration, most of the infant's weight is borne on the bottom portion 28 of the pod 12, although the infant may lean against the anterior portion 24 of the posterior portion 32 of the pod 12.

To place the exterior 10 in this fully upright position, the second end 46 of the spring 14 is inserted fully into the elongated channel 48 formed in the posterior portion 32 of the pod 12, where it is secured by tightening the adjustment knob 52 to cause the threaded shank 54 to bear against the spring 14. The adjustment rod 74, located between the first end 44 of spring 14 and the base 20, is then placed into the set of adjustment grooves 72, formed across positioning bars 70, located furthest from the hinge 16 which pivotally secures the spring 14 to the base 20. In this configuration, the infant may bounce slightly up and down with the spring 14 flexing to accommodate the shifting weight, and the infant's head may be tilted forward until the infant's shoulders bear against shoulder extensions 26 of the anterior portion 24 of the pod 12.

In this position, as well as in other positions of the posture pod 10, the infant's backward movement is restrained by the posterior portion 32 of pod 12. This prevents the infant from falling out of the pod 12 when the infant arches its back. In addition, the side portions 34 of the pod 12 prevent the infant from falling to either side out of the pod 12. The pod 12 is illustrated in FIG. 1 with the padded liner 38 installed within the cavity 22, providing padded cushioning for the infant as well as absorbency. To wash the padded liner 38 or replace it with a padded liner 38 of a different thickness, the liner 38 may be removed by undoing VELCRO tabs 42.

As the infant's posterior neck and back strength increases, it is desirable to tilt the posture pod 10 forwardly towards its fully inclined position, increasing the angle of inclination of the pod 12 and the proportion of the infant's weight that is borne by the anterior portion 24 of the unitary pod 12. The posture pod 10 is illustrated in an intermediate in an intermediate inclined position in FIG. 4. To adjust the posture pod 10 to this position, the adjustment knob 52 is turned to back the threaded shank 54 away from the second end 46 of the spring 14. The second end 46 of the spring 14 may then be slid partially out of the elongated channel 48, causing the pod 12 to project outwardly along the arc cut by the spring 14, increasing the angle of inclination of the unitary pod 12 with respect to the base 20. The adjustment knob 52 is then tightened to cause the threaded shank 54 to bear against the second end 46 of the spring 14, securing its slidable engagement into channel 48. The rotation of the spring 14 from the base 20 is then also adjusted by grasping the knobs 76 on the adjustment rod 74, lifting adjustment rod 74 out of the set of adjustment grooves 72 in which it was located, and moving the adjustment rod forward towards the hinge 16 between the keeper bar 78 and the positioning bar 70 to a new set of adjustment grooves 72. As the adjustment rod 74 is thus advanced towards the hinge 16, the spring 14 is caused to rotate further above the base 20, increasing the angle of inclination of the unitary pod 12.

This process of adjusting the slidable insertion of the second end 46 of spring 14 into the channel 48 formed within the posterior portion 32 of the pod 12, and positioning of the adjustment rod 74 within the adjustment grooves 72 located in the positioning bars 70 on the base 20 may be repeated as desired to increase or decrease the angle of inclination of unitary pod 12. At its furthest extreme, the posture pod 10 can be positioned in its fully inclined position, as illustrated in FIG. 5. In this position, most of the infant's weight is borne by the anterior portion 24 of the pod 12. The infant's arms and legs are free to dangle and the infant's head is unsupported and may hang down slightly between the shoulder extensions 26 of the anterior portion 24. The infant may lift its head and neck as desired, restrained only by the safety limitation of the posterior portion 32.

As discussed previously, for heavier infants the outriggers 84 that are pivotally secured to the base 20 may be repositioned as the angle of inclination of the pod is changed to best support the shifting center of weight of the infant 12. When in the fully upright position of FIG. 2, the outriggers are preferentially rotated to extend the area of the base to the rear and to the sides. When the posture pod 10 is in its fully inclined position, the outriggers are preferentially rotated to extend the area of the base to the front and to the sides as shown in FIG. 5. When posture pod 10 is not in use, the outriggers 84 may be completely folded underneath the base 20 to reduce its size for storage.

In the alternate embodiment of the posture pod illustrated in FIGS. 6 and 7, outriggers 88 are slidably secured to the bottom surface 90 of the base 92. When the posture pod is in use, the outriggers 88 are slid to project outwardly from under the base 92 to increase its area all around its perimeter. When the posture pod is not in use, the outriggers 88 can be slidably retracted to underlie the base for storage.

DESCRIPTION OF A SECOND PREFERRED EMBODIMENT

A second preferred embodiment of the posture pod is illustrated in FIGS. 8–12. The abduction posture pod 112 includes an integral abduction pod 112 similar to the previously described posture pod 12, with the exception of several differences to be described. The abduction posture pod 112 is configured to maintain an infant's hip in a desired degree of abduction and flexion and thereby assist in the growth and development of a normal, stable hip joint. The abduction pod 112 is supported and elevated above the ground by a stand 113.

Figures 8, 8A:
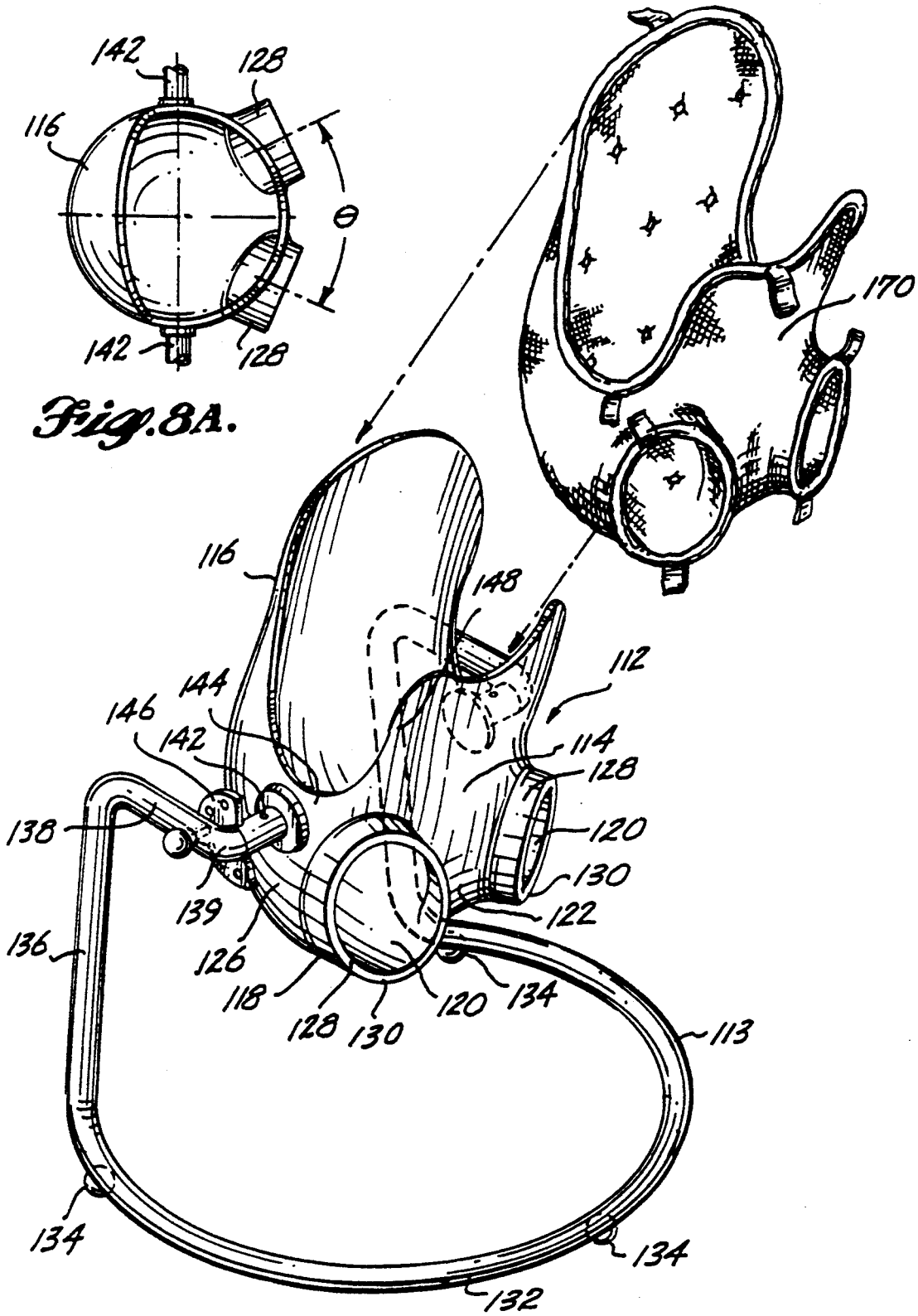
FIG. 8 is an isometric view of a second preferred embodiment of an abduction posture pod which favors the normal development of the hip joint.
FIG. 8A is a top view of the posture pod shown in FIG. 8.

As shown in FIG. 8, the abduction pod 112 includes an anterior portion 114 joined to a posterior portion 116 by a bottom portion 118, and two leg openings 120. These features of the abduction pod 112 are similar to the previously described anterior portion 24, posterior portion 32, bottom portion 28, and leg openings 40 of the posture pod 12.

The abduction pod 112 also includes a crotch portion 122 separating the leg openings 120 at the junction of the anterior portion 114 and the bottom portion 118. The legs of an infant seated in the pod 112 project through the leg openings 120 and its buttocks rest on the bottom portion 118. The posterior portion 116 of the pod 112 includes a lower hip portion 126 anatomically conformed to surround and support the infant's hips.

The infant's legs are separated, or abducted, to a desired degree due to the presence of the relatively wide crotch portion 122. As shown in FIG. 8, the crotch portion 122 curves gently across its width, towards the leg openings, to conform to the infant's anatomy and facilitate abduction. The lower hip portion 126 of the pod 112 serves to comfortably support the infant's hips.

The lower hip portion 126 and crotch portion 122 thus maintain the infant's hips within a desired range of abduction from 20 degrees to 30 degrees, preferably of approximately 25 degrees, from the infant's central line of symmetry. However, it should be apparent that by adjusting the width of the crotch portion 122 and the conformation of the lower hip portion 126, abduction pods may be constructed in accordance with the present invention to achieve other degrees of abduction when desired.

In the preferred embodiment of FIG. 8, the abduction pod 112 also includes two integral generally tubular thigh collars 128 surrounding the leg openings 120 and projecting outwardly therefrom to comfortably support the thigh. The pod 112 is elevated above the ground by the stand 124, so that when the pod is in a generally upright position, the weight of the infant's legs bears against the bottom portion 118 of the abduction pod 112 and the bottom of the thigh is supported by portions 130 of each thigh collar 128. The thigh collars are oriented to provide flexion on the order of 25 degrees to 35 degrees, preferably approximately 30 degrees, measured with respect to the infant's back.

The abduction pod 112 is mounted on the stand 113 to enable anterior (forward) inclination of the abduction pod to facilitate the above-described beneficial effects of maintaining the child in a forward recumbent position. When the abduction pod 112 is forwardly inclined, the infant's legs are supported by upper thigh support portions of the thigh collars 128. The support and mounting of the abduction pod 112 on the stand 113 shall now be described with reference to FIGS. 8 and 9.

The stand 113 illustrated is preferably formed from a single integral length, or assembled shorter sections, of structural tubing. The stand 113 has a generally horseshoe-shaped center base portion 132. The base portion 132 is supported by three or more caster rollers 134 rotatably secured to the base portion 132 to enable rolling relocation of the pod 112. The stand 113 further includes two elevation portions 136 projecting upwardly from the ends of the horseshoe-shaped center base portion 132. The elevation portions 136 are canted slightly inwardly toward each other. The upper end of each elevation portion 136 is bent or otherwise formed to terminate in a short mounting portion 138. The mounting portions 138 have longitudinal axes that are generally parallel to each other and to a plane defined by the base portion 132, and project over the center portion 132. Finally, the distal end of each mounting portion 138 is bent or otherwise formed into opposing orthogonal end portions 139 for mounting of the abduction pod 112. Each end portion 138 receives a short tubular stub shaft 140.

Figure 9:
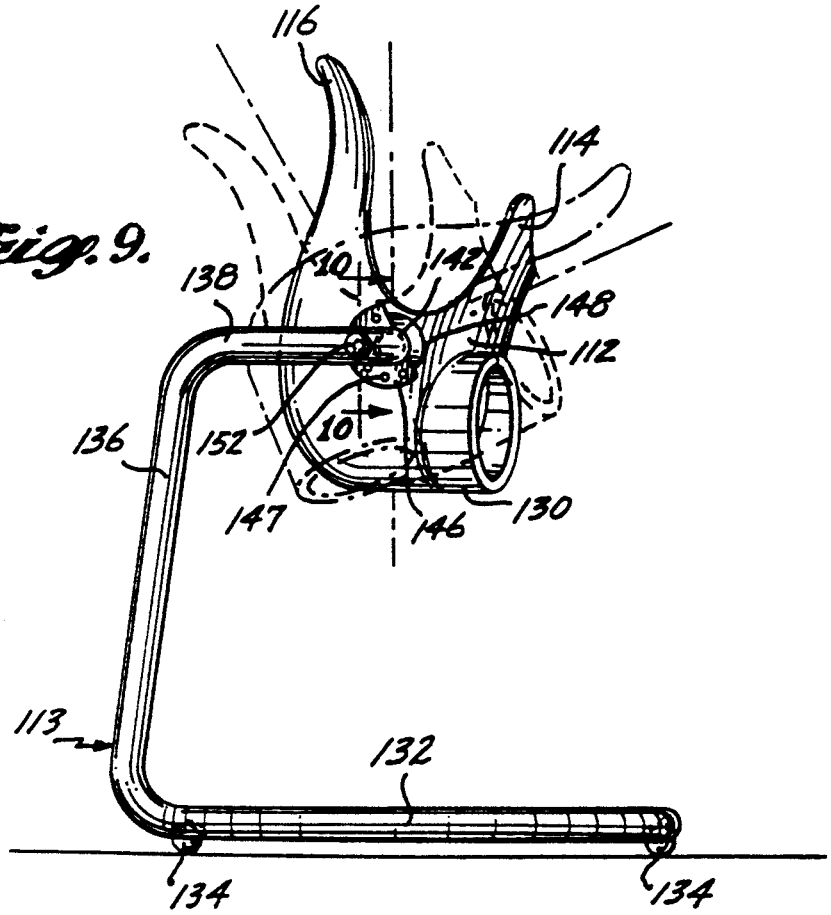
FIG. 9 is a side elevation view of the posture pod of FIG. 8 with dashed lines showing positioning of the posture pod in the reclined and inclined positions.

The stub shafts 140 are received by two cylindrical mounting collars 142, secured to and projecting outwardly from lateral portions 144 of the abduction pod 112, above and slightly behind the leg openings 120. The abduction pod 112 is thus mounted substantially over the center of gravity of the stand 113 and elevated above the ground. The mounting collars 142 are rotatable on the stub shaft portions 140 of the stand 113, enabling the posture pod to rotate about an axis 148 between inclined and reclined positions, as shown in FIGS. 8 and 9.

The abduction pod 112 further includes a mechanism to selectively position the posture pod to a desired degree of incline or recline. A detent plate 146 is secured radially to the mounting collar 142 adjacent the hip portion 126 of the abduction pod 112. The detent plate 146 defines a generally semi-cylindrical periphery defined about the rotational axis 148 of the pod 112. A number of spaced detents or holes are formed through the detent plate along an arcuate path traced about the axis of rotation 148 of the abduction pod 112. As the abduction pod 112 is rotated about the axis 148, the detents 147 align sequentially with a plunger hole 150 formed laterally through the adjacent mounting portion 138 of the stand 113. A spring-biased plunger pin 152 includes a tip 153 that is inserted through the plunger hole 150 to engage with the aligned detent hole 147 to selectively position the abduction pod 112 in a desired degree of inclination or recline, as illustrated in FIG. 9.

In the most reclined position, the infant's back rests against the posterior portion 116, which is reclined from an orthogonal to the base. In a fully anterior inclined position, the infant's chest is supported by the anterior portion 114 of the pod 112, which is inclined from an orthogonal to the base 132 and nearly approaching a parallel to the base 132.

Figure 10:
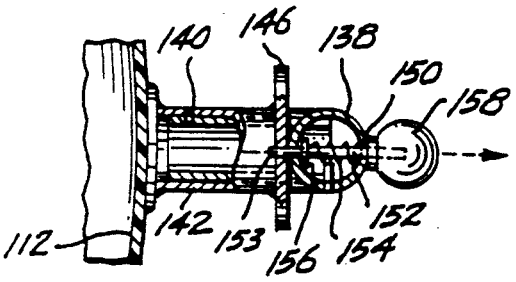
FIG. 10 is a partial cross-sectional view taken along section 10—10 of FIG. 9 showing detail of a spring plunger and detent position selection mechanism.
Figure 11:
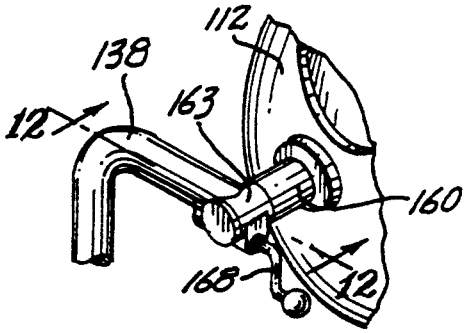
FIG. 11 is a partial isometric view of an alternate worm gear positioning mechanism.
Figure 12:
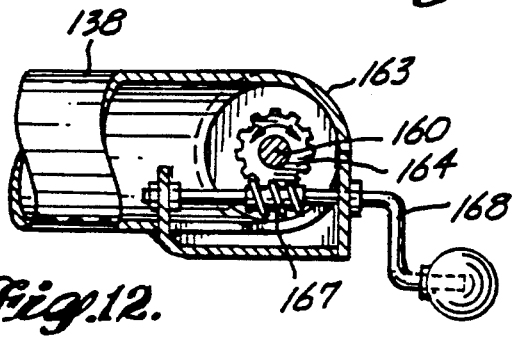
FIG. 12 is a partial cross-sectional view taken along line 12—12 of FIG. 11 showing detail of the worm gear positioning mechanism.

Reference is now had to FIG. 10 for a more detailed description of the mounting of the plunger pin 152 within the stand 113. A coil spring 154 is installed within each mounting portion 138 of the stand 113 and axially aligned with the plunger hole 150 formed therethrough. A retaining washer 156 is mounted to an end of the spring 154 closest to the pod 112. The plunger pin 152 has a spherical grip 158 secured to its outer end. The tip 153 of the plunger pin 152 is inserted through the plunger hole 150 and the aligned coil spring 154 and washer 158. The tip 153 of the pin 152 is secured within the retaining washer 158 by a press fit, threading, or other conventional method. Normally, the coil spring 154 biases the tip 153 of the plunger pin 152 towards the detent plate 146, where it is received by one of the detent holes 147 to lock the pod 112 at a selected inclined or reclined position. However, as indicated in FIG. 10, the grip 156 may be pulled outwardly away from the detent plate to withdraw the plunger pin tip 153 from the plate 146 to allow repositioning of the pod 112.

Other conventional positioning mechanisms may be utilized to selectively position the abduction pod between inclined and reclined positions. One such alternate positioning mechanism suitable for use on the present invention is illustrate in FIGS. 11 and 12. Two shafts 160 project outwardly from the lateral portions 144 of the pod 112. The outer extremity of each shaft 160 is necked down to form a stub shaft 166 that is received within a bearing (not shown) within transverse cylindrical collar 163, secured to the end of the mounting portion 138 of the stand 113. A spur gear 164 is secured to stub shaft 166. A worm gear 167 is rotatably mounted on a crank 168 within the collar 163 on the mounting portion 138 and engages with the bevel gear 164. Rotation of the crank 168 by hand rotates the shaft 160, and thus the pod 112 about shaft 166.

The abduction posture pod 112 may also be supported by other types of stands that serve to elevate the pod off the ground. For example, the abduction pod 112 could be supported by an arc-shaped spring similar to the spring 14 used to support the first preferred embodiment of a recumbent pod 10. In this configuration, the abduction pod 112 would be used only in an upright or forwardly inclined position, rather than in the reclined position.

It is also noted that pads 170, as illustrated in FIG. 8, may be included with the abduction posture pod 112 for comfort and to adjust sizing. The pads 170 would be secured by VELCRO TM -type closures as in the previous preferred embodiment.

The present invention has been described in relation to several preferred embodiments. One of ordinary skill after reading the foregoing specification will be able to affect various changes, alterations, and substitutions of equivalents without departing from the broad concepts disclosed. One example of such an alteration is the addition of a safety strap to secure the waist of the infant to the anterior portion 24 of the pod 12 or anterior portion 114 of the pod 112 to insure the safety of particularly rambunctious infants located in the fully inclined posture pod.

It should also be apparent that alternate means of posterior restraint may be employed in place of the rigid posterior portion of the pod 12, such as a nylon harness, with the spring 14 in that case slidably attached directly to the anterior portion 24 of the pod 12.

It should be further apparent that an alternate elongation member may be utilized in place of the arc-shaped spring 14 to space the pod 12 away from the base 20. One such example would be an elevation rod pivotally secured to the base and also pivotally secured to the pod, with a suspension member projecting upwardly from the base and passing through a slot in the elevation rod, and a coil spring situated over the suspension member between the elevation rod and the base to maintain the spacing and provide suspension for the posture pod.

Finally, rather than a flat base 20, other types of bases conventionally utilized for chairs and other items of furniture may be utilized, such as a cross-shaped tree with rotatable casters mounted on the under surface.

In view of these and other possible changes, alterations and substitutions of equivalents, it is intended that the scope of Letters Patent granted hereon be limited only by the definition contained in the appended claims and the equivalents thereof.

The embodiments of the invention in which an exclusive properly or privilege is claimed are defined as follows:

1. An apparatus for supporting an infant in a musculoskeletal desired position, comprising:

a base; and a continuous, one-piece support pod mounted on the base for receiving an infant and having collar portion means for surrounding the infant's thighs and containing the infant's hips such that the legs are flexed at the hip to a desired degree and abducted at an angle of 20 degrees to 30 degrees, measured relative to the infant's central line of symmetry, to promote normal development of the infant's hips.

2. The apparatus of claim 1, wherein the support member includes a bottom portion, against which the infant's buttocks rest, and a crotch portion projecting outwardly from the bottom portion so as to cover the infant's crotch and of sufficient width to maintain the infant's legs to a desired degree of abduction at the hip.

3. The apparatus of claim 2, wherein the support member further includes a posterior portion projecting outwardly from the bottom portion and generally conforming to the exterior contour of the infant's hip to maintain the infant's legs to a desired degree of abduction.

4. The apparatus of claim 3, further comprising an elevation member having a base end secured to the base and a distal end secured to the support member, the elevation member elevating the support member above the base such that the weight of the infant's legs aids in maintaining the desired degree of flexion.

5. The apparatus of claim 4, wherein the support member constrains the infant's hips such that the infant's legs are flexed at the hip at an angle of approximately 25 degrees to 35 degrees from alignment with the infant's back.

6. The apparatus of claim 4, wherein the support member further includes two lateral portions joining the crotch portion and the posterior portion above the collar portion means to prevent the infant from sliding to either side out of the support member.

7. The apparatus of claim 6, wherein the posterior portion of the support member extends outwardly from the bottom portion to support the infant's back.

8. The apparatus of claim 7, wherein the support member further includes an anterior portion extending from the crotch portion, outwardly away from the bottom portion to support the infant's chest and shoulders.

9. The apparatus of claim 8, further comprising means for selectively positioning the support member over a range spanning between a reclined position, in which the infant is supported by the posterior portion in a position reclined from an orthogonal to the base, and an inclined position, which the infant is supported by the anterior portion in a position inclined from an orthogonal to the base and approaching a parallel to the base.

10. The apparatus of claim 9, wherein the elevation member and the base comprise an integral stand having a center portion contoured to form the base and two elevation portions extending upwardly from the center portion, each elevation portion upwardly terminating in a mounting portion projecting toward the centerline of the base portion, the support member being pivotably mounted between the mounting portions of the stand.

11. The apparatus of claim 10, wherein the stand comprises an integral length of structural tubing.

12. The apparatus of claim 10, wherein the means for selectively positioning the support member comprises:

a positioning plate secured to the support member adjacent one of the mounting portions of the stand, having a plurality of detents formed therein and arranged in an arcuate position;

plunger means slidably secured to the mounting portion of the base and insertable into a selected detent in the positioning plate; and bias means to urge the plunger means into insertion with the selected detent.

13. An apparatus for bearing an infant's weight in semi-inclined vertical position by supporting the infant's anterior torso, the apparatus comprising:

(a) a base for stabilizing the apparatus;

(b) an elevation member having a first end and a second end, the first end being secured to the base and the second end projecting upwardly from the base; and (c) a continuous, one-piece support pod secured to the second end of the elevation member and having collar portion means for surrounding the infant's thighs, an anterior portion against which the infant's anterior torso bears, and a rigid bottom portion, extending outwardly from the anterior portion, against which the infant's buttocks bear, with the support member allowing substantially unrestricted movement of the infant's head, the collar portion means maintaining the infant's hip joints abducted at an angle of 20 degrees to 30 degrees, measured relative to the infant's central line of symmetry, to provide normal development of the infant's hips.

* * * * *